United States Patent [19]

Garner-Gray et al.

[11] Patent Number: 4,966,606

[45] Date of Patent: Oct. 30, 1990

[54] DETERGENT COMPOSITION

[75] Inventors: Peter F. Garner-Gray, Lancashire; Peter C. Knight, Cheshire; Ian Niven, Liverpool, all of United Kingdom

[73] Assignee: Lever Brothers Company, division of Conopco, Inc., New York, N.Y.

[21] Appl. No.: 114,187

[22] Filed: Oct. 28, 1987

[30] Foreign Application Priority Data

Nov. 7, 1986 [GB] United Kingdom ..... 8626691

[51] Int. Cl.[5] ..... C11D 3/37; C11D 10/02

[52] U.S. Cl. ..... 252/174.14; 252/131; 252/135; 252/DIG. 1; 252/140; 252/174.25; 106/465

[58] Field of Search ..... 252/174.25, 131, 135, 252/160, 116, 174.14, 140

[56] References Cited

U.S. PATENT DOCUMENTS

| | | | |
|---|---|---|---|
| 3,992,314 | 11/1976 | Cherney | 252/160 |
| 4,019,998 | 4/1977 | Benson et al. | 252/135 |
| 4,022,702 | 5/1977 | Curtis | 252/135 |
| 4,035,257 | 7/1977 | Cherney | 252/160 |
| 4,040,988 | 8/1977 | Benson et al. | 252/532 |
| 4,049,586 | 9/1977 | Collier | 252/532 |
| 4,076,653 | 2/1978 | Davies et al. | 252/532 |
| 4,164,478 | 8/1979 | Nishio et al. | 252/135 |
| 4,174,291 | 11/1979 | Benjamin et al. | 252/156 |
| 4,196,093 | 4/1980 | Clarke et al. | 252/99 |
| 4,395,345 | 7/1983 | Walz et al. | 252/135 |
| 4,711,740 | 12/1987 | Carter et al. | 252/174.24 |

FOREIGN PATENT DOCUMENTS

| | | |
|---|---|---|
| 2275552 | 1/1974 | France . |
| 2296594 | 7/1976 | France . |
| 1437950 | 8/1973 | United Kingdom . |
| 1515273 | 9/1974 | United Kingdom . |
| 2120293 | 4/1982 | United Kingdom . |
| 2174712 | 5/1985 | United Kingdom . |

*Primary Examiner*—A. Lionel Clingman
*Assistant Examiner*—John F. McNally
*Attorney, Agent, or Firm*—Ronald A. Koatz

[57] ABSTRACT

Particulate detergent compositions containing a detergent active system, sodium carbonate and a calcite seed crystal exhibit improved dispensibility from automatic washing machines when the mean particle size is at least 500 microns, such as above 700 microns and the level of particles with a size below 50 microns is less than 2% by weight of the overall composition. The Rosin-Rammler distribution n value should be at least 4 when the means particle size is 700 microns but may be as low as 2 when the mean is 1200 microns. When the sodium carbonate and calcite are in separate particles, the sizes thereof should be similar.

4 Claims, No Drawings

DETERGENT COMPOSITION

This invention relates to detergent compositions, in particular to detergent compositions intended to be used for washing fabrics in an automatic washing machine, and more especially to such compositions which contain little or no phosphorus containing materials.

Detergent compositions usually contain, in addition to a detergent active material, a detergency builder whose role, inter alia, is to remove hardness ions from the wash liquor which would otherwise reduce the efficiency of the detergent active material. Water-soluble phosphate materials have been extensively used as detergency builders. However for a number of reasons, including eutrofication allegedly caused by phosphates and cost, there has been a desire to use alkali metal carbonates especially sodium carbonate instead. Alkali metal carbonate detergency builders suffer however from a number of disadvantages. Firstly, the reaction between the alkali metal carbonate and calcium ions which are present in hard water results in the formation of water-insoluble calcium carbonate which, depending on the conditions, may be in such a form as to become deposited on the washed fabrics. Secondly, the reaction between the alkali metal carbonate and the calcium ions of the water is slow, especially at low temperatures and is readily inhibited by materials which act as calcium carbonate precipitate growth inhibitors, referred to herein as poisons. The result of this is that the concentration of calcium ions in the wash liquor is not reduced as far or as fast as desired, so that some free calcium ions are still available to reduce the efficiency of the detergent active material.

As a possible solution to this problem it has been proposed to include in the detergent composition, a water-insoluble material which would act as a seed crystal for the precipitated calcium carbonate and would adsorb the poisons from the wash liquor. Among other materials, finely divided calcite has been proposed as such a material—see GB No. 1 437 950 (UNILEVER).

However, it has been found that such detergent compositions in comparison with equivalent compositions containing phosphates as detergency builders, often suffer from poor dispensibility in automatic washing machines. In such machines the user places an appropriate amount of detergent powder in a dispenser where it is retained until needed by the machine. At an appropriate moment in the washing cycle, water enters the dispenser and washes the powder into a feed pipe leading to the washing compartment of the machine. If the powder is not substantially washed out of the dispenser by the process, not only is it wasted but after repeated use it will build up and eventually block the dispenser and/or the feed pipe. Alternatively, it requires the user to clean out the dispenser after each wash cycle.

The reason for the poor dispensibility of carbonate/calcite based powders in some machines is not fully understood, but we have surprisingly discovered that relatively good dispensibility can be obtained by controlling the particle size of the powders.

We are aware of proposals in the art for improving the dispensibility of detergent powders. Thus British Patent Specification No. GB 2120293-A (Colgate Palmolive) proposes to improve the dispensibility of bentonite containing powders by the addition of a siliconate. Also European Patent Specification No. EP49920

(Unilever) proposes to improve the dispensibility of phosphate/silicate granules for dishwashing by the addition of a hydrophobing material such as calcium stearate.

We have found that these proposals are not sufficiently effective when applied to carbonate/calcite powders.

According to the invention there is provided a detergent composition comprising a detergent active system, a water-soluble alkali metal carbonate and a water-insoluble carbonate material which is a seed crystal for calcium carbonate, the composition being in particulate form, the particles having a mean size of at least 500 microns and less than 2% by weight of the particles having a size of less than 50 microns.

The mean size of the particles of the composition should be at least 500 microns, preferably more that 700 microns. We have found that larger particles inherently provide better dispensing than smaller particles, and the compositions may therefore contain a substantial proportion of large particles such as more than 10% by weight of particles having a particle size of more than 1700 microns.

When the mean particle size is close to the lower limit of 500 microns, it is important that the powder has a narrow particle size distribution, to ensure that the level of particles below 50 microns is below the required limit. Thus with a mean particle size of 700 microns, we have found it necessary that the Rosin-Rammler distribution n value is at least 4, whereas with a mean particle size of 1200 microns, successful dispensibility can be achieved with a wider distribution n value of 2.

As used herein, particle size means the particle size as measured by sieve analysis.

The composition may contain particles containing different ingredients or different levels of ingredients depending on the method by which the composition is prepared. In this invention it is the particle size distribution of the overall composition which is critical.

Preferably the composition contains from 5% to 40% by weight of the detergent active system, preferably not more than 25%.

The detergent active system may be selected from anionic non-soap detergent actives, nonionic detergent actives, soap, mixtures of two or more thereof and mixtures thereof with other detergent active materials.

Suitable non-soap (synthetic) anionic detergent active compounds are the water-soluble alkali metal salts of an organic sulphate and sulphonate having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$–$C_{18}$) alcohols produced for example from tallow or coconut oil, sodium and potassium alkyl ($C^9$–$C^{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Suitable nonionic detergent compounds include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally up to 25 EO, ie up to 25 units of ethylene oxide per molecule, the condensation of aliphatic ($C_8$–$C_{18}$) primary or secondary linear or branched alcohols with ethylene oxide, generally up to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

As used herein, the term "soap" includes not only the usual alkali metal and alkaline earth metal salts of fatty acids, but also the organic salts which can be formed by complexing fatty acids with organic nitrogen-containing materials such as amines and derivatives thereof. Usually, the soap comprises salts of higher fatty acids containing from 8 to 24 carbon atoms, preferably from 10 to 20 carbon atoms in the molecule, or mixtures thereof.

Preferred examples of soaps include sodium stearate, sodium palmitate, sodium salts of tallow, coconut oil and palm oil fatty acids and complexes between stearic and/or palmitic fatty acid and/or tallow and/or coconut oil and/or palm oil fatty acids with water-soluble alkanolamines such as ethanolamine, di- or triethanolamine, N-methylethanol- amine, N-ethylethanolamine, 2-methylethanolamine and 2,2-dimethyl ethanolamine and N-containing ring compounds such as morpholine, 2'-pyrrolidone and their methyl derivatives.

Mixtures of soaps can also be employed.

Particularly preferred are the sodium and potassium salts of the mixed fatty acids derived from coconut oil and tallow, that is sodium and potassium tallow and coconut soap.

An essential ingredient of the composition is a water-soluble carbonate material as a builder. This is preferably sodium or potassium carbonate or a mixture thereof, for reasons of cost and efficiency. The carbonate salt is preferably fully neutralised but it may be partially neutralised, for example a sesquicarbonate may be used in partial replacement of the normal carbonate salt; the partial salts tend to be less alkaline and therefore less efficient. The amount of water-soluble carbonate material in the detergent composition can be varied widely, but the amount should be at least 5% by weight, such as from 10% to 40%, preferably 10% to 35% by weight, though an amount of up to 75% could possibly be used if desired in special products. The amount of the water-soluble carbonate material is determined on an anhydrous basis, though the salts may be hydrated either before or when incorporated into the detergent composition. It should be noted that it may also be desirable to limit the carbonate content to a lower level within the range mentioned, so as to decrease the risk of internal damage following any accidental ingestion, for example by children.

The composition necessarily contains a water-insoluble particulate carbonate material. This material must be capable of acting as a seed crystal for the precipitate which results from the reaction between the calcium hardness ions of the water and the water-soluble carbonate. Thus this water-insoluble particulate material is a seed crystal for calcium carbonate, such as calcium carbonate itself.

The water-insoluble particulate carbonate material should be finely divided, and should have a surface area of at least 10 $m^2/g$, and preferably at least 15 $m^2/g$. The particularly preferred material has surface area from 30–100 $m^2/g$ Insoluble carbonate material with surface areas in excess of 100 $m^2/g$ may be used, if such materials are economically available.

Surface area is measured by nitrogen absorption using the standard Bruauer, Emmet & Teller (BET) method. A suitable machine for carrying out this method is a Carlo Erba Sorpty 1750 instrument operated according to the manufacturer's instructions.

It is most preferred that the high surface area material be prepared in the absence of poisons, so as to retain its seed activity.

When the insoluble carbonate material is calcium carbonate, any crystalline form thereof may be used or a mixture thereof, but calcite is preferred as aragonite and vaterite are less readily available commercially, and calcite is a little less soluble than aragonite or vaterite at most usual wash temperatures. When any aragonite or vaterite is used it is generally in admixture with calcite. In the following general description, the term 'calcite' is used to mean either calcite itself or any other suitable water-insoluble calcium carbonate seed material.

The selected level of calcite in the overall composition depends on the specific surface area as described above. The amount of calcite used in the compositions should be from 5% to 60%, more preferably from 5% to 30%.

In addition to the water-insoluble carbonate material, the detergent active material and the water-soluble carbonate material it is possible to include minor amounts of other detergency builders, provided that the total amount of the detergency builders does not exceed 85% by weight, so as to leave room in the detergent composition for other desirable ingredients.

Apart from the calcite, the detergent active compounds and detergency builders, the detergent composition can optionally contain any of the conventional ingredients in the amounts in which such ingredients are normally employed in fabric washing detergent compositions.

One such optional ingredient is an alkali metal silicate, particularly sodium neutral, alkaline, meta- or orthosilicate. A low level of silicate, for example 5–10% by weight, is usually advantageous in decreasing the corrosion of metal parts in fabric washing machines, and it may give processing benefits. If higher levels of silicate are used up to a practical maximum of 30%, for example from 10% to 20% by weight, there can be a more noticeable improvement in detergency, which may permit some decrease in the water-soluble carbonate material content. This effect appears to be particularly beneficial when the wash liquor are used in water with appreciable levels of magnesium hardness. The amount of silicate can also be used to some extent to control the equilibrium pH of the wash liquor, which is generally within the range of 9–11, preferably 10–11 for an aqueous solution of the composition at the recommended concentration. It should be noted that a higher pH (ie over pH 10.5) tends to be more efficient as regards detergency, but it may be less desirable for domestic safety. Sodium silicate is commonly supplied in concentrated aqueous solution, but the amounts are calculated on an anhydrous basis.

Examples of other optional ingredients include the lather boosters such as alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents such as trichloroisocyanuric acid, fabric softening agents, inorganic salts such as sodium sulphate, and, usually present in very minor amounts, fluorescent agents, perfumes, enzymes such as proteases and amylases, germicides and colourants.

The detergent compositions may be produced by any of the techniques commonly employed in the manufacture of fabric washing detergent compositions, including particularly slurry-making and spray-drying processes for the manufacture of detergent powders.

The compositions may be prepared in such a manner that the water-soluble alkalimetal carbonate and the water-insoluble carbonate material are contained in separate different particles. We have found that when such a process is used, it is of advantage of the mean sizes of these separate particles are similar, in particular that they do not differ by more than 500 microns, preferably not more than 300 microns.

The invention will now be illustrated by the following non-limiting examples.

EXAMPLE 1

A composition was prepared having the following formulation (by weight), the Trade Names of the materials used being given where appropriate.

| | | |
|---|---|---|
| Anionic detergent active | 7% | (DOBANE 113) |
| Nonionic detergent active | 2% | (DOBANOL 45-11) |
| Soap | 4% | (Sodium soap of hardened STEARINE fatty acid) |
| Sodium carbonate | 35% | |
| Calcite | 15% | (SOCAL U3) |
| Sodium silicate | 6% | |
| Sucrose | 3% | |
| Sodium sulphate | 8.5% | |
| Sodium perborate tetrahydrate | 13.0% | |
| Enzyme granules | 0.26% | |
| Perfume | 0.2% | |
| Water and minor ingredients | balance | |

This composition was prepared by spraying a slurry of the ingredients with the exception of the perborate, the sodium silicate, the enzyme and the perfume and then post dosing the remaining ingredients.

The mean particle size of the overall composition was microns and the level of particles having a size below microns was zero.

To this composition was added various amounts of silica powder having a particle size of 10 microns. Each composition obtained in this manner was subjected to a dispenser residue test as follows.

In each example 150 g of powder was placed in the dispenser of a HOOVER (Trade Mark) automatic washing machine. Cold water was allowed to enter the dispenser at a rate of 2 liters per minute for 2 minutes. The water had a hardness of 24° FH. (i.e. a free calcium ion concentration of $24\times10^{-4}$ molar). The water pressure was 5 psi. After allowing the water to drain naturally out of the dispenser the weight of the powder residue therein was measured.

A residue weight of less than 20 g in this test is considered acceptable. It was found that acceptable dispensing of the composition occurred when the level of added silica was less that 2%. Above this level more than 20 g of the composition remained in the dispenser at the end of the test.

EXAMPLE 2

A composition was prepared having the following formulation (by weight).

| | |
|---|---|
| Anionic detergent active[1] | 7.7% |
| Nonionic detergent active[1] | 3.4% |
| Soap[1] | 3.4% |
| Sodium carbonate | 30.0% |
| Calcite[1] | 20.0% |
| Sodium silicate | 6.0% |
| Sucrose | 4.0% |
| Sodium sulphate | 2.2% |
| Sodium perborate monohydrate | 10.0% |
| Enzyme granules | 0.5% |
| Foam control granules | 3.2% |
| Perfume | 0.2% |
| Water and minor ingredients | balance |

Notes 1- The same materials as used in Example 1.

The mean particle size of the overall composition was 550 microns and the level of particles having a size below 50 microns was zero. Some of this powder was grind and sieved to provide a 30 microns size fraction. It was found that both 1% and 2% of the 30 microns size powder could be added to the main powder while still retaining good dispensibility, as measured using the test described in Example 1.

EXAMPLE 3

Two compositions were prepared having the following formulations (by weight).

| | |
|---|---|
| Base composition | |
| Anionic detergent active[1] | 7.0 parts |
| Nonionic detergent active[1] | 2.0 parts |
| Sodium carbonate | 20.0 parts |
| Sodium silicate | 8.0 parts |
| Water and minor ingredients | 6.68 parts |
| Total | 43.68 parts |
| Calcite granule | |
| Calcite[1] | 20.0 parts |
| Sodium carbonate | 10.0 parts |
| Anionic detergent active[1] | 4.0 parts |
| Sucrose | 4.0 parts |
| Water | 1.2 parts |
| Total | 39.2 parts |

Each composition was sieved into a number of size fractions. 43.68 parts of the base composition were mixed with 29.4 parts of calcite granules at the same size fraction. The dispensibility of the mixture was then assessed as described in Example 1. The results were as follows:

| Size fraction (microns) | Dispenser Residue (g) |
|---|---|
| <250 | 102 |
| 250–355 | 94 |
| 355–500 | 116 |
| 710–1000 | 19 |
| 1000–1700 | 1 |

These results show that with a mean particle size of less than 500 microns, dispensibility is unacceptable. Above a mean particle size of about 700 microns, acceptable dispensibility is obtained.

EXAMPLE 4 (COMPARATIVE)

A commercially available detergent composition which contains sodium tripolyphosphate as a builder rather than a carbonate/calcite mixture, was used for this experiment. Using the method described in Example 1, the dispenser residues of a powder fraction having a mean size below 500 microns was measured to which various amounts of a less than 50 micron size fraction (Fines) had been added. The results were as follows:

| % fines added | Dispenser Residue (g) |
|---|---|
| 0 | 1.0 |
| 2 | 0.6 |
| 5 | 1.0 |

From these results one can see that dispensibility is not a problem with this product, even when the mean particle size is below 500 microns and even when a significant level of fines is present

We claim:

1. A particulate detergent composition having improved disproved dispensibility comprising i. from 5% to 40% by weight of a detergent active system containing one or more detergent actives selected from selected from the group consisting of anionic non-soap detergent actives, nonionic detergent actives and soap;

ii. from 10% to 40% by weight of a water-soluble alkali metal carbonate selected from selected from the group consisting of sodium carbonate, potassium carbonate and mixtures thereof;

iii. from 5% to 60% by weight of a seed crystal for calcium carbonate selected from the selected from group consisting of calcite and mixtures thereof with aragonite or vaterite, the seed crystal having a surface area of at least 10 $m^2/g$, said composition being in the form of particles having a mean size of at least 500 microns, less than 2% by weight of said particles having a size of less than 50 microns, with the proviso that said particles have a Rosin-Rammler distribution n value of at least 4 if the mean particle size of the particles of the entire composition is not more than 700 microns.

2. A detergent composition according to claim 1, wherein the mean size of said particles is more than 700 microns.

3. A detergent composition according to claim 1, wherein more than 10% by weight of said particles have a particle size of more than 1700 microns.

4. A detergent composition according to claim 1, comprising a first group of particles containing said water-solution alkalimetal carbonate and a second group of separate different particles admixed with said particles of the first group and containing said water-insoluble carbonate material, the mean size of said first group of particles differing from the mean size of said second group of particles by not more than 500 microns.

* * * * *